US005158744A

United States Patent [19]

Nazmy

[11] Patent Number: 5,158,744

[45] Date of Patent: Oct. 27, 1992

[54] OXIDATION- AND CORROSION-RESISTANT ALLOY FOR COMPONENTS FOR A MEDIUM TEMPERATURE RANGE BASED ON DOPED IRON ALUMINIDE, $FE_3AL$

[75] Inventor: Mohamed Nazmy, Fislisbach, Switzerland

[73] Assignee: Asea Brown Boveri Ltd., Baden, Switzerland

[21] Appl. No.: 721,273

[22] Filed: Jun. 26, 1991

[30] Foreign Application Priority Data

Jul. 7, 1990 [EP] European Pat. Off. ..... 90113008.8

[51] Int. Cl.[5] ..... C22C 38/06; C22C 38/26

[52] U.S. Cl. ..... 420/62; 430/79

[58] Field of Search ..... 420/62, 79

[56] References Cited

U.S. PATENT DOCUMENTS 1,990,650 2/1935 Jaeger ..... 420/79

3,026,197 3/1962 Schramm ..... 420/79

FOREIGN PATENT DOCUMENTS 1323724 3/1963 France .

9010722 9/1990 PCT Int'l Appl. .

OTHER PUBLICATIONS

Fracture & Microstructure, General Abstract Session, Feb. 1982.

"Effects of $DO_3$ Transitions on the Yield Behavior of Fe-Al Alloys", Inouye, Mat. Res. Soc. Symp. Proc. vol. 39, 1985 Materials Research Society, pp. 255-261.

*Primary Examiner*—Deborah Yee

*Attorney, Agent, or Firm*—Burns, Doane, Swecker & Mathis

[57] ABSTRACT

Oxidation- and corrosion-resistant alloy for components for a medium temperature range based on doped iron aluminide $Fe_3Al$ having the following composition:

Al=24-28 at.-%

Nb=0.1-2 at.-%

Cr=0.1-10 at.-%

B=0.1-1 at.-%

Si=0.1-2 at.-%

Fe=remainder.

At 550° C. high temperature yield points of 500 to more than 650 MPa are obtained.

14 Claims, 4 Drawing Sheets

$\sigma_{0,2}$ MPa
1000
900
800
700
600
500
400
300
200
100
17
16
15
14
13
12
0
100
200
300
400
500
600
700
800
900
1000
1100
1200
T(°C)

OXIDATION- AND CORROSION-RESISTANT ALLOY FOR COMPONENTS FOR A MEDIUM TEMPERATURE RANGE BASED ON DOPED IRON ALUMINIDE, $FE_3AL$

BACKGROUND OF THE INVENTION

1. Field of the Invention

Alloys for the medium temperature range for heat engines based on intermetallic compounds, which are suitable for directional solidification, are replacing stainless steels and in part supplement the conventional nickel-based superalloys or are replacing other intermetallic compounds.

The invention relates to the further development and improvement of the alloys based on an intermetallic compound of the iron aluminide $Fe_3Al$ type using further additives which improve the mechanical properties (strength, toughness, ductility).

In the narrower sense, the invention relates to an oxidation- and corrosion-resistant alloy for components for a medium temperature range based on doped iron aluminide $Fe_3Al$.

2. Discussion of Background

Intermetallic compounds and alloys derived therefrom have recently been gaining increasing importance as materials which can be used in the medium and high temperature ranges. Nickel aluminides and titanium aluminides, which in part supplement or replace conventional nickel-based superalloys, are generally known.

The various iron aluminides have been known for a long time, in particular as oxidation-resistant and non-scaling protective coats on components made of iron and steel. Because of their relative brittleness, these intermetallic compounds, which are produced by spraying aluminum onto steel bodies and then annealing, have, however, hardly been considered as construction materials. Recently, however, in particular the iron-rich alloys located in the vicinity of the $Fe_3Al$ phase have been investigated in more detail in respect of their suitability as materials for the temperature range from room temperature up to about 600° C. It has also already been proposed to improve their properties by co-alloying further elements. Materials of this type have been able to compete successfully with the conventional corrosion-resistant steels in the temperature range around about 500° C. With respect to the prior art, the published documents are cited below:

H. Thonye, "Effects of $DO_3$ transitions on the yield behaviour of Fe-Al Alloys", Metals and ceramics division, Oak Ridge National Laboratory, Oak Ridge, Tenn. 37831, Mat. Res. Soc. Symp. proc. Vol 39, 1985 Materials Research Society.

S. K. Ehlers and M. G. Mandiratta, "Tensile behaviour of polycrystalline Fe-31 at.-% Al Alloy", Systems Research Laboratories Inc., Dayton, Ohio 45440, TMS Annual Meeting Feb. 1982, The Journal of Minerals, Metals and Materials Society.

The known alloys based on $Fe_3Al$ do not yet satisfy the technical requirements in all respects. There is, therefore, a need for their further development.

SUMMARY OF THE INVENTION

The object on which the invention is based is to indicate a comparatively inexpensive alloy having high oxidation- and corrosion-resistance in the medium temperature range (300° to 700° C.) and, at the same time, adequate thermal stability and sufficient toughness at room temperature and in the lower temperature range, which alloy is easily castable and is also suitable for directional solidification. The alloy should essentially consist of a comparatively high-melting intermetallic compound containing further additives.

This object is achieved in that the alloy has the following composition:

Al=24–28 at.-%
Nb=0.1–2 at.-%
Cr=0.1–10 at.-%
B=0.1–1 at.-%
Si=0.1–2 at.-%
Fe=remainder

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
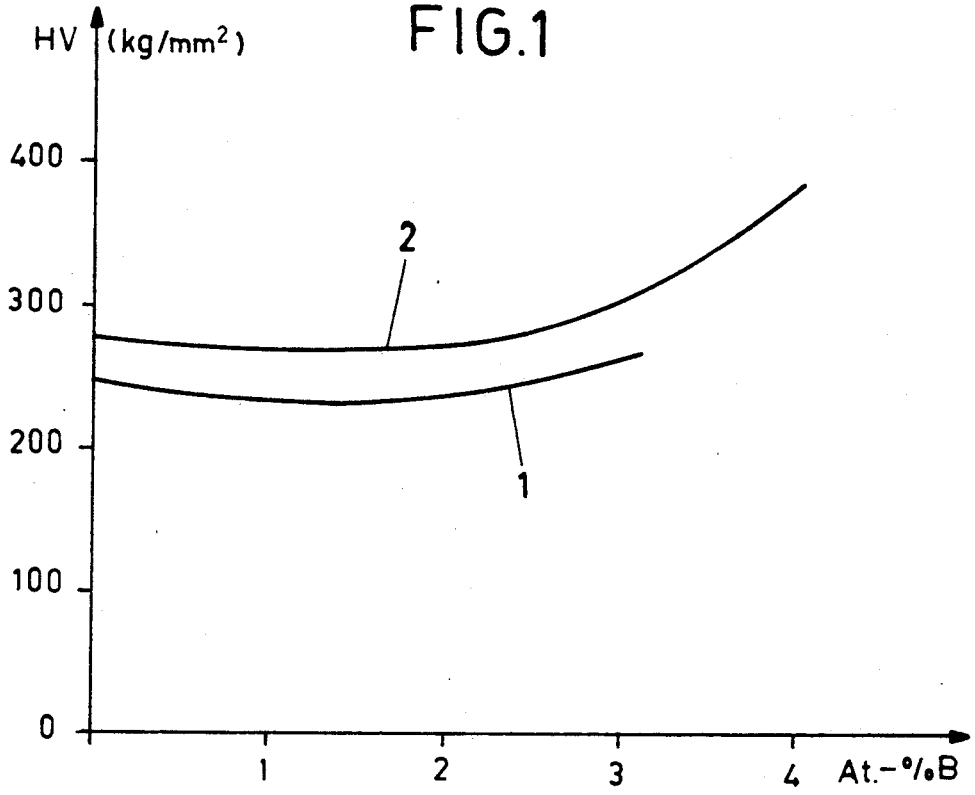
FIG. 1 shows a graphical representation of the influence of the addition of B on the Vickers hardness HV ($kg/mm^2$) of a few alloys based on the intermetallic compound iron aluminide $Fe_3Al$ at room temperature.

Referring now to the drawings, FIG. 1 is a graphical representation of the influence of the addition of B on the Vickers hardness ($kg/mm^2$) of a few alloys based on the intermetallic compound iron aluminide $Fe_3Al$ at room temperature.

The following base alloys were studied:

| | | |
|---|---|---|
| Curve 1: | Al = | 28 at. % |
| | Nb = | 1 at. % |
| | Cr = | 5 at. % |
| | Fe = | remainder. |

The amount of B added varied between 0.1 at.-% and a maximum of 3 at.-% at the expense of the Fe content.

| | | |
|---|---|---|
| Curve 2: | Al = | 28 at. % |

-continued

| | | |
|---|---|---|
| | Nb = | 1 at. % |
| | Cr = | 5 at. % |
| | Si = | 2 at. % |
| | Fe = | remainder. |

The amount of B added varied between 0.1 at.-% and a maximum of 4 at.-% at the expense of the Fe content.

In the case of small additions of B, a slight fall in the Vickers hardness could initially be found, from which a certain ductilization could already be concluded. In the case of B contents of more than about 1.5 at.-%, the Vickers hardness increased again, which is probably to be ascribed to the precipitation of hard borides.

Figure 2:
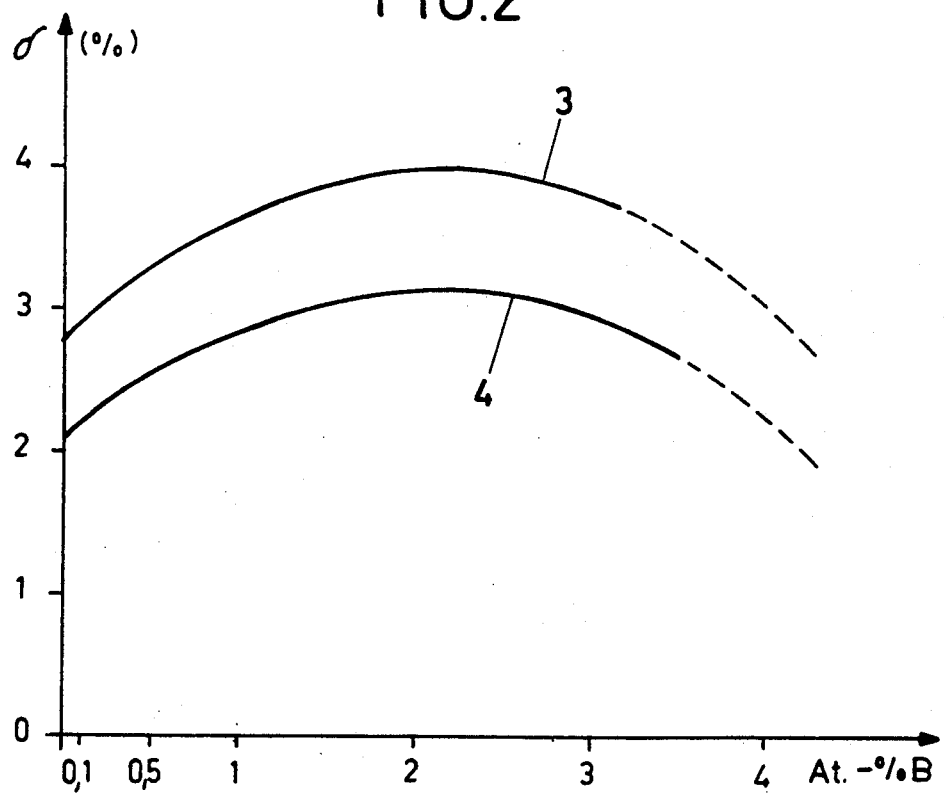
FIG. 2 shows a graphical representation of the influence of the addition of B on the elongation at break $\delta$ (%) of a few alloys based on the intermetallic compound iron aluminide $Fe_3Al$ at room temperature.

FIG. 2 shows a graphical representation of the influence of the addition of B on the elongation at break δ (%) of a few alloys based on the intermetallic compound iron aluminide $Fe_3Al$ at room temperature.

The following base alloys were studied:

| | | |
|---|---|---|
| Curve 3: | Al = | 28 at. % |
| | Nb = | 1 at. % |
| | Cr = | 5 at. % |
| | Fe = | remainder. |

The amount of B added varied between 0.1 at.-% and a maximum of 3 at.-% at the expense of the Fe content.

| | | |
|---|---|---|
| Curve 4: | Al = | 28 at. % |
| | Nb = | 1 at. % |
| | Cr = | 5 at. % |
| | Si = | 2 at. % |
| | Fe = | remainder. |

The amount of B added varied between 0.1 at.-% and a maximum of 4 at.-% at the expense of the Fe content.

As a result of the addition of B it was possible first to observe an increase in the elongation at break, a maximum occurring at about 2 at.-% in each case. On further increasing the amount of B added, the elongation at break decreased again as a consequence of embrittlement (boride precipitations).

Figure 3:
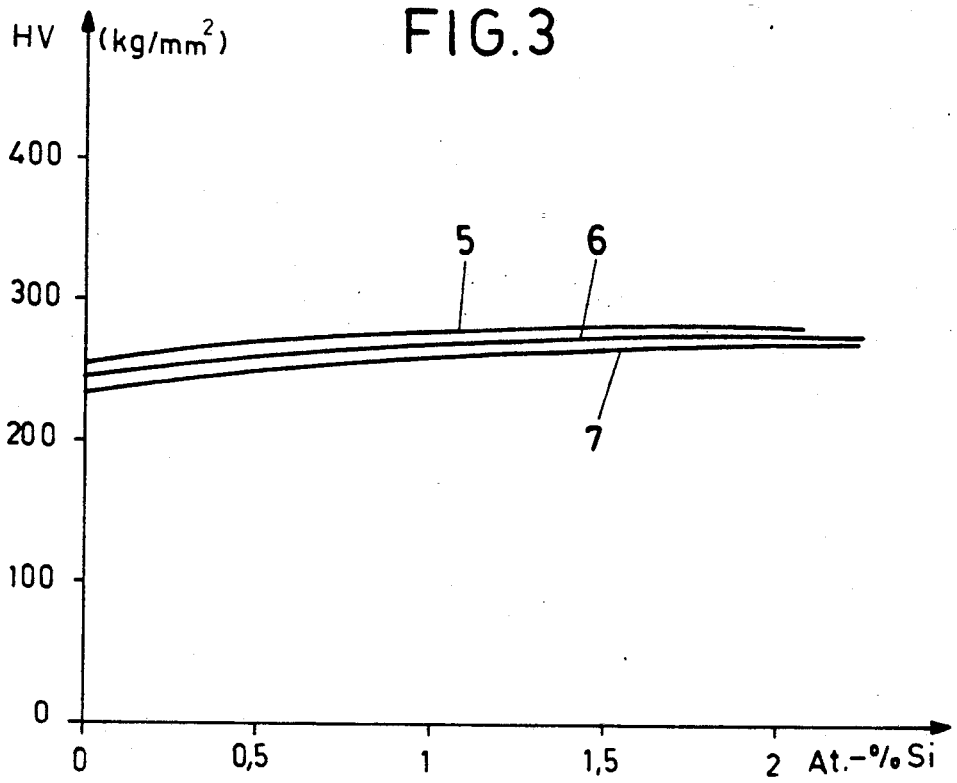
FIG. 3 shows a graphical representation of the influence of the addition of Si on the Vickers hardness HV ($kg/mm^2$) of a few alloys based on the intermetallic compound iron aluminide $Fe_3Al$ at room temperature.

FIG. 3 shows a graphical representation of the influence of the addition of Si on the Vickers hardness HV ($kg/mm^2$) of a few alloys based on the intermetallic compound iron aluminide $Fe_3Al$ at room temperature.

The following base alloys were studied:

| | | |
|---|---|---|
| Curve 5: | Al = | 28 at. % |
| | Nb = | 1 at. % |
| | Cr = | 5 at. % |
| | Fe = | remainder. |

The amount of Si added varied between 0.5 and a maximum of 2 at.-% at the expense of the Fe content.

| | | |
|---|---|---|
| Curve 6: | Al = | 28 at. % |
| | Nb = | 1 at. % |
| | Cr = | 5 at. % |
| | B = | 0.1 at. % |
| | Fe = | remainder. |

The amount of Si added varied between 0.5 and a maximum of 2 at.-% at the expense of the Fe content.

| | | |
|---|---|---|
| Curve 7: | Al = | 28 at. % |
| | Nb = | 1 at. % |
| | Cr = | 5 at. % |
| | B = | 1 at. % |
| | Fe = | remainder. |

The amount of Si added varied between 0.5 and a maximum of 2 at.-% at the expense of the Fe content.

The addition of Si effected an increase in the Vickers hardness in all alloys.

In these studies it was possible to observe that the loss in hardness effected by the addition of about 1 at.-% of B could be more than made good by the addition of Si.

Figure 4:
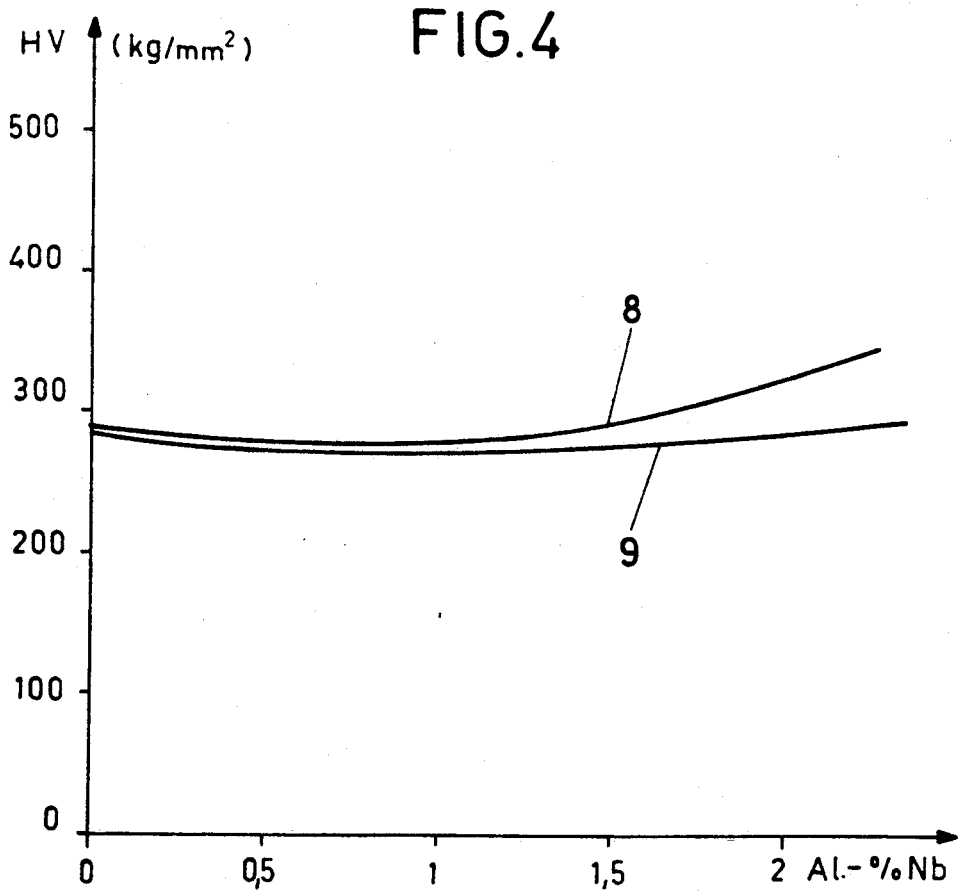
FIG. 4 shows a graphical representation of the influence of the addition of Nb on the Vickers hardness HV ($kg/mm^2$) of a few alloys based on the intermetallic compound iron aluminide $Fe_3Al$ at room temperature.

FIG. 4 is a graphical representation of the influence of the addition of Nb on the Vickers hardness HV ($kg/mm^2$) of a few alloys based on the intermetallic compound iron aluminide $Fe_3Al$ at room temperature.

The following base alloys were studied:

| | | |
|---|---|---|
| Curve 8: | Al = | 28 at. % |
| | Cr = | 5 at. % |
| | Fe = | remainder. |

The amount of Nb added varied between 0.5 at.-% and a maximum of 2 at.-% at the expense of the Fe content.

| | | |
|---|---|---|
| Curve 9: | Al = | 28 at. % |
| | Cr = | 5 at. % |
| | Si = | 2 at. % |
| | Fe = | remainder. |

The amount of Nb added varied between 0.6 at.-% and a maximum of 2 at.-% at the expense of the Fe content.

Up to a content of about 1 at.-% of Nb, the Vickers hardness decreased slightly before again reaching or exceeding the original value of the Nb-free alloys at about 1 at.-% of Nb.

Figure 5:
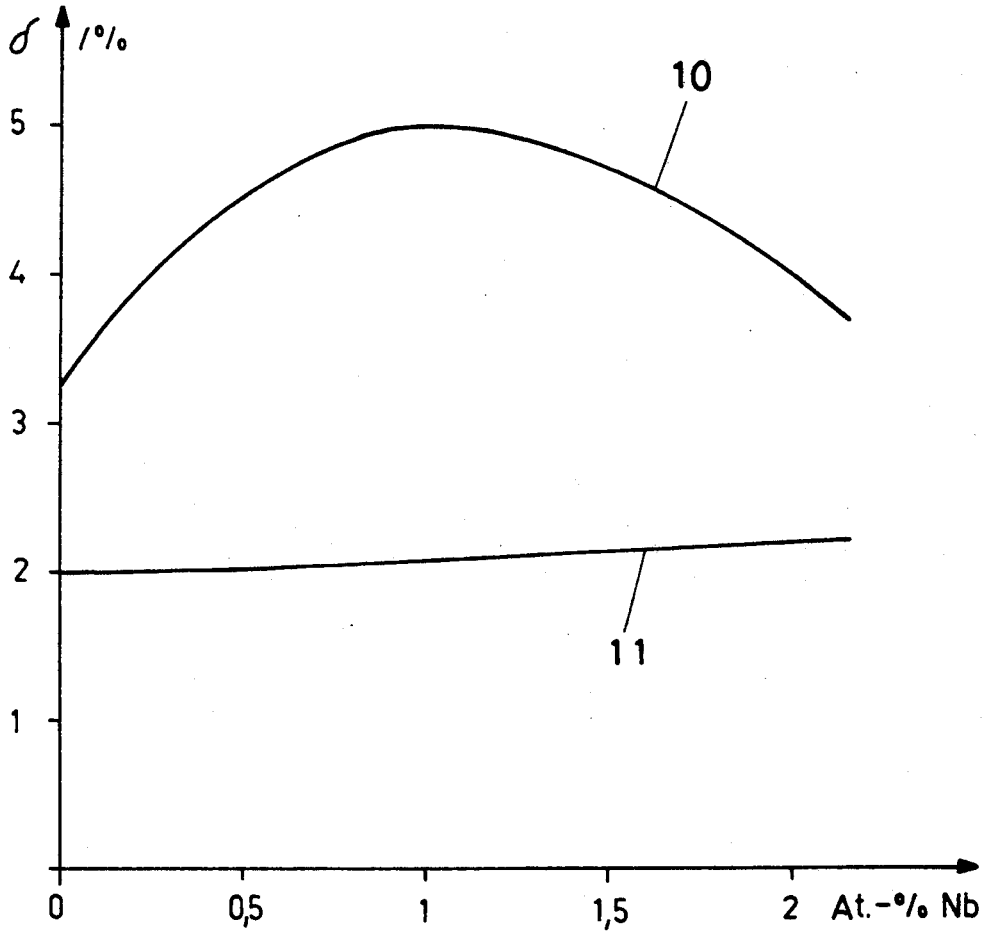
FIG. 5 shows a graphical representation of the influence of the addition of Nb on the elongation at break $\delta$ (%) of a few alloys based on the intermetallic compound iron aluminide $Fe_3Al$ at room temperature.

FIG. 5 shows a graphical representation of the influence of the additon of Nb on the elongation at break δ (%) of a few alloys based on the intermetallic compound iron aluminide Fe3Al at room temperature.

The following base alloys were tested:

| | | |
|---|---|---|
| Curve 10: | Al = | 28 at. % |
| | Cr = | 5 at. % |
| | Fe = | remainder. |

The amount of Nb added varied between 0.5 at.-% and a maximum of 2 at.-% at the expense of the Fe content.

| | | |
|---|---|---|
| Curve 11: | Al = | 28 at. % |
| | Cr = | 5 at. % |
| | Si = | 2 at. % |
| | Fe = | remainder. |

The amount of Nb added varied between 0.5 at.-% and a maximum of 2 at.-% at the expense of the Fe content.

According to curve 10, the elongation at break of the alloy passed through a pronounced maximum at about 1 at.-% of Nb before falling again at higher Nb contents.

This behavior could not be observed in the case of the Si-containing alloy according to curve 11. Moreover, the elongation at break values remained considerably below those for the alloy according to curve 10.

Figure 6:
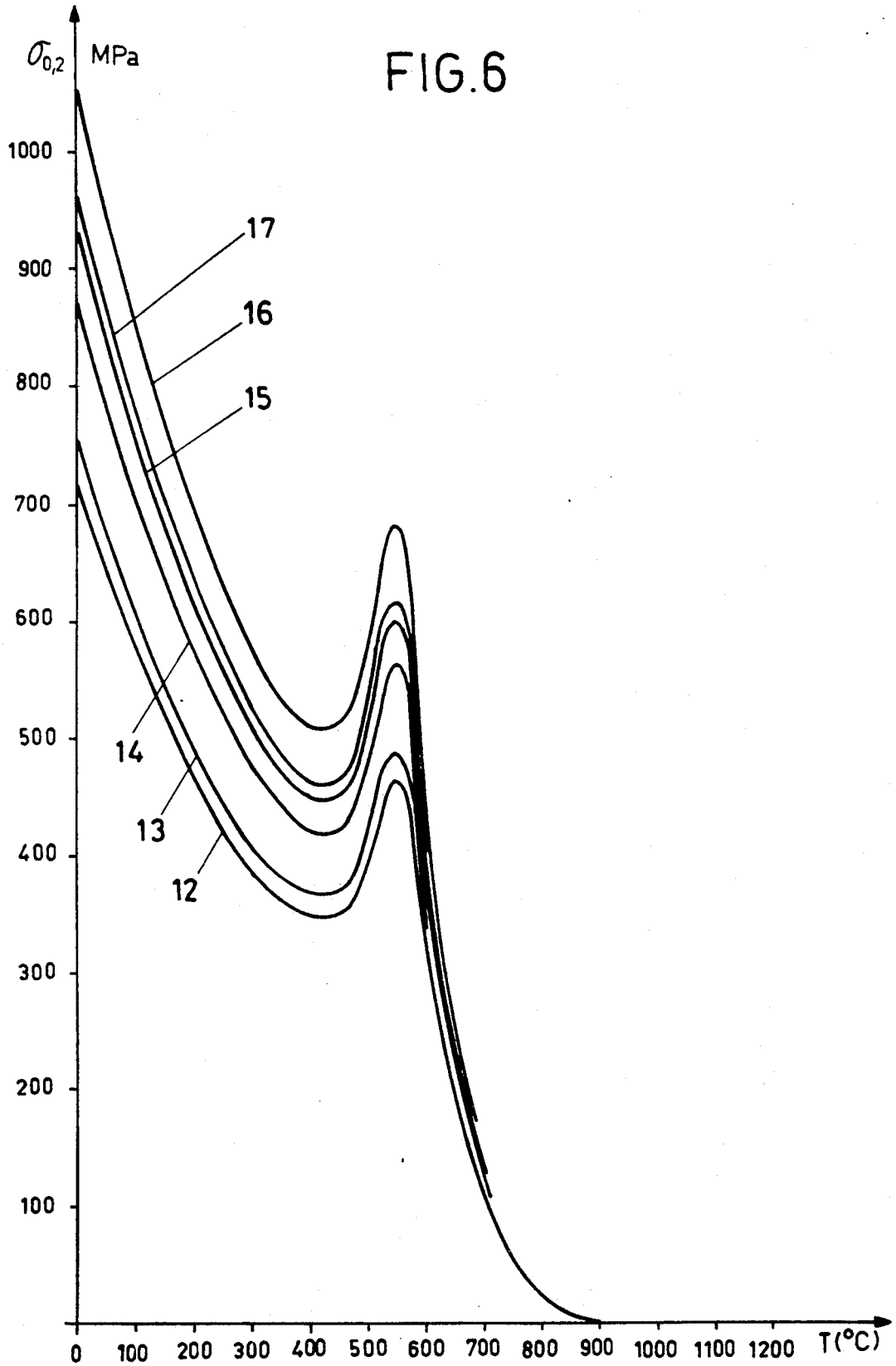
FIG. 6 shows a graphical representation of the yield point $\sigma_{0.2}$ (MPa) as a function of the temperature for a group of alloys based on the intermetallic compound iron aluminide $Fe_3Al$.

FIG. 6 is a graphical representation of the yield point $\sigma_{0.2}$ (MPa) as a function of the temperature T (°C.) for a group of alloys based on the intermetallic compound iron aluminide $Fe_3Al$. The yield point for pure iron aluminide $Fe_3Al$ containing 25 at.-% of Al is shown for comparison. An overview of the influence of the further alloying elements can thus be obtained.

Curve 12: 25 at.-% Al, remainder Fe
Curve 13: 28 at.-% Al, 1 at.-% Nb, 5 at.-% Cr, 1 at.-% B, remainder Fe
Curve 14: 28 at.-% Al, 1 at.-% Nb, 5 at.-% Cr, 1 at.-% B, 2 at.-% Si, remainder Fe
Curve 15: 28 at.-% Al, 1 at.-% Nb, 2 at.-% Cr, remainder Fe
Curve 16: 28 at.-% Al, 2 at.-% Nb, 4 at.-% Cr, remainder Fe
Curve 17: 28 at.-% Al, 2 at.-% Nb, 4 at.-% Cr, 0.2 at.-% B, 2 at.-% Si, remainder Fe All curves show a similar behavior of the material. Up to a temperature of about 400° C. the yield point decreases, initially more sharply and then less sharply to about 50% of the value at room temperature. The yield point passes through a minimum here and rises comparatively steeply again up to a temperature of about 550° C. to about 65% of the value at room temperature. This maximum is typical for the behavior of the intermetallic compounds of the $Fe_3Al$ type. After this maximum, the yield point falls steeply to low values. The highest yield point values were observed in the case of alloys doped with Nb and Cr.

ILLUSTRATIVE EMBODIMENT 1

An alloy of the following composition:
Al=28 at.-%
Nb=1 at.-%
Cr=5 at.-%
Fe=remainder
was melted in an arc furnace under argon as blanketing gas.

The starting materials used were the individual elements having a degree of purity of 99.99%. The melt was cast to give a cast blank about 60 mm in diameter and about 80 mm high. The blank was melted again under blanketing gas and, likewise under blanketing gas, forced to solidify in the form of rods having a diameter of about 8 mm and a length of about 80 mm.

The rods were processed directly, without subsequent heat treatment, to pressure samples for short-term tests. The mechanical properties obtained in this way were measured as a function of the test temperature.

A further improvement in the mechanical properties by means of a suitable heat treatment is within the realm of the possible. Moreover, the possibility exists for improvement by means of directional solidification, for which the alloy is particularly suitable.

ILLUSTRATIVE EMBODIMENT 2

The following alloy was melted under argon analogously to Example 1:
Al=28 at.-%
Nb=1 at.-%
Cr=5 at.-%
B=0.1 at.-%
Si=2 at.-%
Fe=remainder.

The melt was cast analogously to illustrative embodiment 1, re-melted under argon and forced to solidify in rod form. The dimensions of the rods corresponded to illustrative embodiment 1. The rods were processed directly to pressure samples, without subsequent heat treatment. The values of the mechanical properties thus obtained, as a function of the test temperature, corresponded approximately to those of Example 1. These values can be further improved by means of a heat treatment.

ILLUSTRATIVE EMBODIMENT 3

The following alloy was melted under an argon atmosphere in exactly the same way as in Example 1:
Al=28 at.-%
Nb=1 at.-%
Cr=5 at.-%
B=1 at.-%
Si=2 at.-%
Fe=remainder.

The melt was cast analogously to Example 1, re-melted under argon and cast to give prisms of square cross-section (8 mm×8 mm×100 mm). Specimens for pressure, hardness and impact tests were prepared from these prisms. The mechanical properties corresponded approximately to those of the preceding examples. A heat treatment gave a further improvement in these values.

ILLUSTRATIVE EMBODIMENT 4

The following alloy was melted under argon:
Al=28 at.-%
Nb=1 at.-%
Cr=5 at.-%
Fe=remainder.

The procedure was precisely the same as under Example 1.

ILLUSTRATIVE EMBODIMENT 5

The following alloy was melted under argon:
Al=28 at.-%
Nb=0.5 at.-%
Cr=6 at.-%
B=0.5 at.-%
Si=1.5 at.-%
Fe=remainder.
The procedure was analogous to Example 1.

ILLUSTRATIVE EMBODIMENT 6

The following alloy was melted under argon:
Al=28 at.-%
Cr=3 at.-%
Nb=1.5 at.-%
B=0.7 at.-%
Si=1 at.-%
Fe=remainder.
The procedure corresponded to that of Example 1.

ILLUSTRATIVE EMBODIMENT 7

The following alloy was melted:
Al=26 at.-%
Nb=2 at.-%
Cr=1 at.-%
B=1 at.-%
Si=0.5 at.-%
Fe=remainder.
The procedure was in accordance with Example 1.

ILLUSTRATIVE EMBODIMENT 8

The following alloy was melted in an induction furnace under an argon atmosphere:

Al=24 at.-%
Nb=1 at.-%
Cr=10 at.-%
B=0.5 at.-%
Si=2 at.-%
Fe=remainder.

The procedure corresponded to that of Example 1.

ILLUSTRATIVE EMBODIMENT 9

The following alloy was melted under argon:

Al=28 at.-%
Nb=0.8 at.-%
Cr=5 at.-%
B=0.8 at.-%
Si=1 at.-%
Fe=remainder.

The procedure was as indicated under Example 1.

EXAMPLE OF THE ELEMENTS

The resistance to oxidation is further increased by co-alloying the element Cr. The influence on the mechanical properties (strength, ductility, toughness, elevated temperature hardness) appears to be variable depending on which further alloying components are also present and the detailed nature of the crystal structure. In combination with Nb, Cr, for certain contents of further additional doping elements, appears to have a favorable effect. Additions of more than 10 at.-% of Cr generally impair the mechanical properties again.

In certain ranges, the element Nb increases the hardness and the strength. The ductility (elongation at break) passes through a maximum at 1 at.-% of Nb for certain alloys.

By means of co-alloying B it is generally attempted to increase the ductility. However, its effect appears to be advantageous overall only in the presence of certain other elements. At low B contents, the hardness falls slightly, before rising again at contents of more than 2 at.-%. At very high B contents, this appears to be ascribable to the formation of hard borides. The elongation at break of certain alloys passes through a characteristic maximum at 2 at.-% of B. B contents of more than 2 at.-% are therefore not very expedient. Usually, a maximum of 1 at.-% can suffice.

Si improves the castability and has a favorable effect on the resistance to oxidation. It has a hardness-increasing effect in virtually all alloys and without exception compensates for the decrease in strength caused by additions of B.

The invention is not restricted to the illustrative embodiments.

Quite generally, the oxidation- and corrosion-resistant alloy for components for a medium temperature range based on iron aluminide $Fe_3Al$ has the following composition:

Al=24–28 at.-%
Nb=0.1–2 at.-%
Cr=0.1–10 at.-%
B=0.1–1 at.-%
Si=0.1–2 at.-%
Fe=remainder.

Obviously, numerous modifications and variations of the present invention are possible in light of the above teachings. It is thereofore to be understood that within the scope of the appended claims, the invention may be practiced otherwise than as specifically described herein.

What is claimed:

1. An oxidation- and corrosion-resistant alloy for components for a medium temperature range based on doped iron aluminide $Fe_3Al$, which alloy has the following composition:

Al=24–28 at.-%
Nb=0.1–2 at.-%
Cr=0.1–10 at.-%
B=0.1–1 at.-%
Si=0.1–2 at.-%
Fe=remainder.

2. The alloy as claimed in claim 1, which has the following composition:

Al=28 at.-%
Nb=1 at.-%
Cr=5 at.-%
B=0.1 at.-%
Si=2 at.-%
Fe=remainder.

3. The alloy as claimed in claim 1, which has the following composition:

Al=28 at.-%
Nb=1 at.-%
Cr=5 at.-%
B=0.1 at.-%
Si=2 at.-%
Fe=remainder.

4. The alloy as claimed in claim 1, which has the following composition:

Al=28 at.-%
Nb=1 at.-%
Cr=5 at.-%
B=1 at.-%
Si=2 at.-%
Fe=remainder.

5. The alloy as claimed in claim 1, which has the following composition:

Al=28 at.-%
Nb=2 at.-%
Cr=4 at.-%
B=0.2 at.-%
Si=2 at.-%
Fe=remainder.

6. The alloy as claimed in claim 1, which has the following composition:

Al=26 at.-%
Nb=0.5 at.-%
Cr=6 at.-%
B=0.5 at.-%
Si=1.5 at.-%
Fe=remainder.

7. The alloy as claimed in claim 1, which has the following composition:

Al=26 at.-%
Nb=1.5 at.-%
Cr=3 at.-%
B=0.7 at.-%
Si=1 at.-%
Fe=remainder.

8. The alloy as claimed in claim 1, which has the following composition:

Al=26 at.-%
Nb=2 at.-%
Cr=1 at.-%
B=1 at.-%

Si=0.5 at.-%
Fe=remainder.

9. The alloy as claimed in claim 1, which has the following composition:
Al=24 at.-%
Nb=1 at.-%
Cr=10 at.-%
B=0.5 at.-%
Si=2 at.-%
Fe=remainder.

10. The alloy as claimed in claim 1, which has the following composition:
Al=24 at.-%
Nb=0.8 at.-%
Cr=5 at.-%
B=0.8 at.-%
Si=1 at.-%
Fe=remainder.

11. The alloy as claimed in claim 1, having a yield point of at least 500 MPa at 550° C.

12. The alloy as claimed in claim 1, having a yield point of at least 650 MPa at 550° C.

13. The alloy as claimed in claim 1, having an elongation at break of at least 2% at room temperature.

14. The alloy as claimed in claim 1, having a Vickers hardness HV of at least about 250 $kg/mm_2$.

* * * * *